US008121509B2

(12) United States Patent
Hashimoto

(10) Patent No.: US 8,121,509 B2
(45) Date of Patent: Feb. 21, 2012

(54) IMAGE FORMING APPARATUS AND METHOD FOR CONTROLLING THE SAME IN A STEPWISE MANNER

(75) Inventor: Takeaki Hashimoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 642 days.

(21) Appl. No.: 12/292,823

(22) Filed: Nov. 26, 2008

(65) Prior Publication Data

US 2009/0136252 A1 May 28, 2009

(30) Foreign Application Priority Data

Nov. 28, 2007 (JP) ..... 2007-308055
Oct. 28, 2008 (JP) ..... 2008-277211

(51) Int. Cl.
*G03G 15/00* (2006.01)

(52) U.S. Cl. ..... 399/75

(58) Field of Classification Search ..... 399/38, 399/46, 75, 76, 78, 88
See application file for complete search history.

(56) References Cited

U.S. PATENT DOCUMENTS 5,923,919 A * 7/1999 Nimura et al. ..... 399/88

FOREIGN PATENT DOCUMENTS

JP 6-143683 5/1994
JP 3449118 7/2003

* cited by examiner

*Primary Examiner* — William J Royer
(74) *Attorney, Agent, or Firm* — Harness, Dickey & Pierce, P.L.C.

(57) ABSTRACT

A control unit controls a starting process and a stopping process of an image forming unit in a stepwise manner. Upon receiving an instruction for executing an image forming process during the stopping process, a determination unit inquires of the control unit about a stage of the stopping process and determines whether the stopping process in the stage is interruptible. A shutdown unit instructs the control unit to interrupt the stopping process during or after the stage, based on a result of determination by the determination unit. A start-up unit instructs the control unit to perform the starting process after interrupting the stopping process.

12 Claims, 12 Drawing Sheets

FIG. 7

| STOPPING PROCESS IN EACH STAGE | INTERRUPTION DETERMINATION INFORMATION | STARTING PROCESS INFORMATION | | | | | |
|---|---|---|---|---|---|---|---|
| | | PHOTO-SENSITIVE ELEMENT | EXPOSING UNIT | NEUTRALI-ZATION UNIT | TRANSFER UNIT | CHARGING UNIT | DEVELOPING UNIT |
| WAITING FOR SHUTDOWN | INTERRUPTIBLE | UN-NECESSARY | UN-NECESSARY | UN-NECESSARY | UN-NECESSARY | UN-NECESSARY | UN-NECESSARY |
| STOPPING PROCESS OF TRANSFER UNIT | INTERRUPTIBLE | UN-NECESSARY | UN-NECESSARY | UN-NECESSARY | NECESSARY | UN-NECESSARY | UN-NECESSARY |
| STOPPING PROCESS OF CHARGING UNIT | WAITING FOR COMPLETION OF STOPPING PROCESS | UN-NECESSARY | UN-NECESSARY | UN-NECESSARY | NECESSARY | NECESSARY | UN-NECESSARY |
| STOPPING PROCESS OF DEVELOPING UNIT | WAITING FOR COMPLETION OF STOPPING PROCESS | UN-NECESSARY | UN-NECESSARY | UN-NECESSARY | NECESSARY | NECESSARY | NECESSARY |
| NEUTRALIZATION PROCESS OF PHOTOSENSITIVE ELEMENT | INTERRUPTIBLE | UN-NECESSARY | UN-NECESSARY | NECESSARY | NECESSARY | NECESSARY | NECESSARY |
| CLEANING PROCESS OF PHOTOSENSITIVE ELEMENT | INTERRUPTIBLE | UN-NECESSARY | UN-NECESSARY | NECESSARY | NECESSARY | NECESSARY | NECESSARY |
| STOPPING PROCESS OF EXPOSING UNIT | INTERRUPTIBLE | UN-NECESSARY | NECESSARY | NECESSARY | NECESSARY | NECESSARY | NECESSARY |
| STOPPING PROCESS OF PHOTOSENSITIVE ELEMENT | WAITING FOR COMPLETION OF STOPPING PROCESS | NECESSARY | NECESSARY | NECESSARY | NECESSARY | NECESSARY | NECESSARY |

IMAGE FORMING APPARATUS AND METHOD FOR CONTROLLING THE SAME IN A STEPWISE MANNER

CROSS-REFERENCE TO RELATED APPLICATIONS

The present application claims priority to and incorporates by reference the entire contents of Japanese priority document 2007-308055 filed in Japan on Nov. 28, 2007 and Japanese priority document 2008-277211 filed in Japan on Oct. 28, 2008.

BACKGROUND OF THE INVENTION

1. Field of the Invention

The present invention relates to an image forming apparatus and its controlling method.

2. Description of the Related Art

As an image forming unit for an electrophotographic printer, for example, an image forming unit 1100 as shown in FIG. 11 is known. FIG. 11 is a schematic diagram of the image forming unit 1100 that includes a photosensitive element 1101, a charging unit 1102, an exposing unit 1103, a developing unit 1104, a sheet conveying unit 1105, a transfer unit 1106, a cleaning unit 1107, and a neutralization unit 1108. The photosensitive element 1101 rotates in a direction indicated by an arrow "a" in FIG. 11, during which the surface thereof is uniformly charged by the charging unit 1102. The charged surface is irradiated with light corresponding to printing data by the exposing unit 1103, so that a latent image is formed on the surface of the photosensitive element 1101. Then, toner is adhered to the latent image by the developing unit 1104 to form a toner image on the surface of the photosensitive element 1101. The toner image is transferred onto a sheet conveyed by the sheet conveying unit 1105 in a direction indicated by an arrow "b" in FIG. 11. The sheet carrying the toner image is conveyed to a fixing unit (not shown), in which the toner image is fixed to the sheet. Toner remaining on the surface of the photosensitive element 1101 is removed by the cleaning unit 1107, and the neutralization unit 1108 neutralizes the surface of the photosensitive element 1101.

There is a demand for an image forming apparatus that includes such an image forming unit to enable restarting of printing promptly when a printing instruction was received while each unit in the image forming unit is in a stopping process. For example, a technology is disclosed in Japanese Patent Application Laid-open No. H06-143683, in which when an image forming apparatus is instructed to perform a stopping process, the image forming apparatus stands by for a certain period of time in a state of stopping only a developing unit. When a printing instruction is received during the standby, printing can be started only by restarting the developing unit. When the printing instruction is not received during the standby, the stopping process is performed also on the units other than the developing unit such as a transfer unit and a cleaning unit after the certain period of time.

However, in the above technology, the units other than the developing unit are driven uselessly for the certain period of time, so that the lifetime of the units may be shortened. Moreover, even when the printing instruction is received at the moment when the stopping process of each unit of the image forming unit is started, the stopping process of the developing unit is inevitably performed. Therefore, the time required for restarting printing cannot be shortened anymore.

SUMMARY OF THE INVENTION

It is an object of the present invention to at least partially solve the problems in the conventional technology.

According to one aspect of the present invention, there is provided an image forming apparatus including an image forming unit that performs an image forming process; a control unit that controls a starting process and a stopping process of the image forming unit in a stepwise manner; a determination unit that, upon receiving an instruction for executing the image forming process during the stopping process, inquires of the control unit about a stage of the stopping process and determines whether the stopping process in the stage is interruptible; a shutdown unit that instructs the control unit to interrupt the stopping process during or after the stage, based on a result of determination by the determination unit; and a start-up unit that instructs the control unit to perform the starting process after interrupting the stopping process.

Furthermore, according to another aspect of the present invention, there is provided a control method for an image forming apparatus including an image forming unit that performs an image forming process. The control method includes controlling a starting process and a stopping process of the image forming unit in a stepwise manner; determining, upon receiving an instruction for executing the image forming process during the stopping process, including inquiring about a stage of the stopping process, and determining whether the stopping process in the stage is interruptible; shutting-down including instructing to interrupt the stopping process during or after the stage, based on a result of determination at the determining; and starting-up including instructing to perform the starting process after interrupting the stopping process.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 7 is a schematic diagram illustrating a table stored in an engine ROM in the laser-printer control unit according to a modified example of the present invention;

DETAILED DESCRIPTION OF THE PREFERRED EMBODIMENTS

Exemplary embodiments of the present invention are explained in detail below with reference to the accompanying drawings.

In the following explanation, the present invention is employed to a laser printer as an example; however, it is not limited thereto. The present invention can be employed to, for example, a multi-function peripheral (MFP) having a copier function, a facsimile function, a printer function, and the like or an electrophotographic copier.

Figure 1:
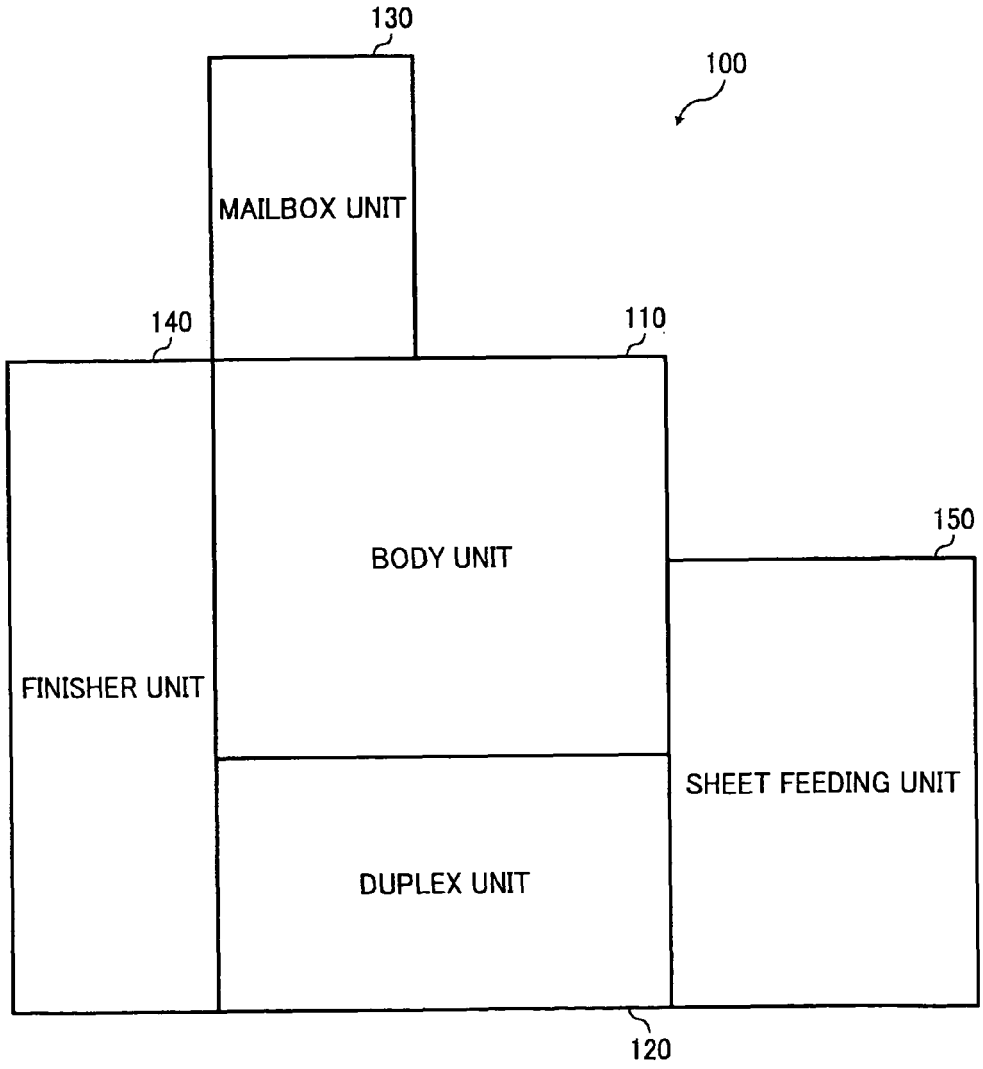
FIG. 1 is a schematic diagram of a unit configuration of a laser printer according to a first embodiment of the present invention.

FIG. 1 is a schematic diagram of a unit configuration of a laser printer 100 according to a first embodiment of the present invention. The laser printer 100 includes a body unit 110, a duplex unit 120, a mailbox unit 130, a finisher unit 140, and a sheet feeding unit 150.

The body unit 110 includes an image forming unit (not shown) for printing an image on a recording medium (sheet) that includes a registration unit and a fixing unit, controls a printing process (image forming process) such as imaging, developing, and fixing, and feeds sheets on which images are to be printed.

The duplex unit 120 reverses a sheet by a reversing (switch-back) mechanism and feeds the reversed sheet for a duplex printing.

The mailbox unit 130 includes a plurality of discharge ports for discharging sheets and discharges printed sheets from any discharge port. In the present embodiment, the mailbox unit 130 is a 2-bin mailbox.

The finisher unit 140 performs post-processing such as a stacking process for sorting printed sheets for each job by shifting them and a stapling process.

The sheet feeding unit 150 includes a sheet feeding tray in which sheets are loaded and conveys sheets to the registration unit.

Figure 2:
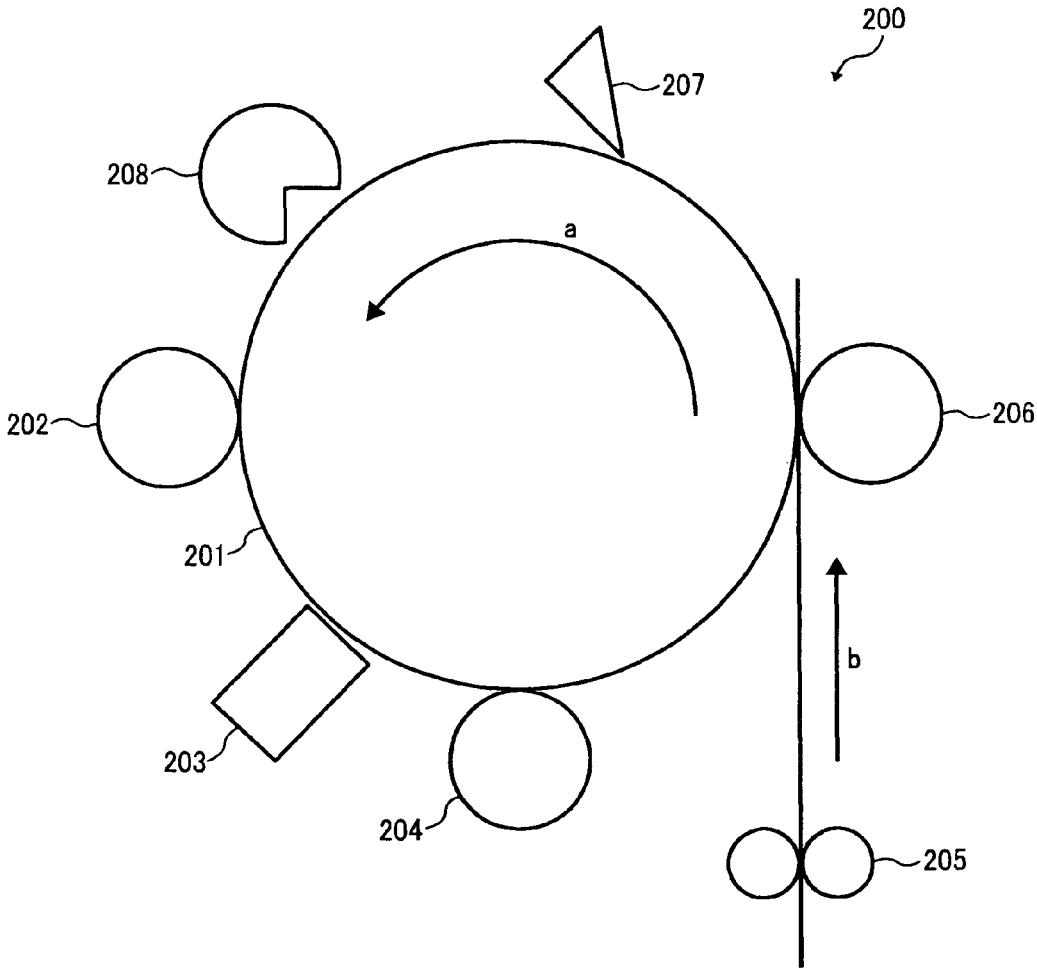
FIG. 2 is a schematic diagram of an image forming unit for an electrophotographic printer of the laser printer.

As an example of the image forming unit in the body unit 110, an image forming unit that includes an image forming unit 200 for an electrophotographic process is explained. FIG. 2 is a schematic diagram of the image forming unit 200. The image forming unit 200 performs an image forming process, and includes a photosensitive element (image carrier) 201, a charging unit 202, an exposing unit 203, a developing unit 204, a sheet conveying unit 205, a transfer unit 206, a cleaning unit (removing unit) 207, a neutralization unit 208, and a driving unit (not shown). The photosensitive element 201 is rotated by the driving unit in a direction indicated by an arrow "a" in FIG. 2, and the charging unit 202 charges the surface of the photosensitive element 201. The charged surface of the photosensitive element 201 is exposed by the exposing unit 203, whereby a latent image is formed thereon. The developing unit 204 causes charged toner to adhere to the latent image to form a toner image on the surface of the photosensitive element 201. The sheet conveying unit 205 conveys a sheet in a direction indicated by an arrow "b" in FIG. 2, and the transfer unit 206 transfers the toner image onto the sheet conveyed by the sheet conveying unit 205. The cleaning unit 207 removes residual toner remaining on the surface of the photosensitive element 201, and the neutralization unit 208 neutralizes the surface of the photosensitive element 201 after the transfer process.

Figure 3:
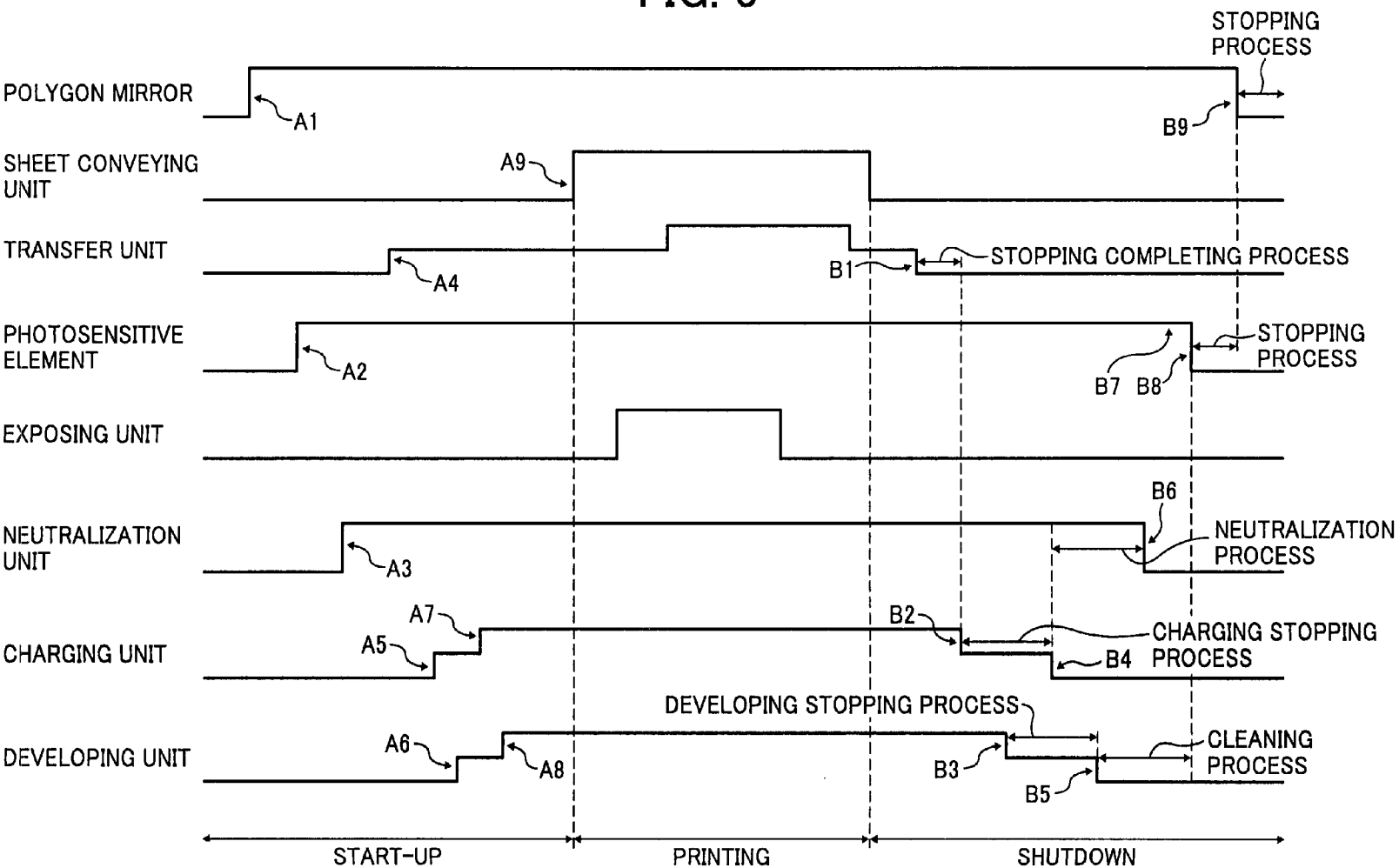
FIG. 3 is a timing chart of a printing operation of the image forming unit.

The procedure and the content of the printing operation of the image forming unit 200 when the image forming unit 200 performs the printing process are explained with reference to FIG. 3. FIG. 3 is a timing chart of the printing operation of the image forming unit 200. When printing is started, the image forming unit 200 starts the printing operation shown in FIG. 3 to cause the image forming unit 200 to be in a printable state. The printing operation is classified into a start-up (starting process), a printing process, and a shutdown (stopping process).

The starting process of the image forming unit 200 is explained with reference to FIG. 3.

First, a laser-printer control unit causes a polygon mirror for exposure (not shown) to rotate stably (A1). Then, the laser-printer control unit drives the photosensitive element 201 to rotate stably by the driving unit (A2). Then, the laser-printer control unit drives the neutralization unit 208 (A3). Then, the laser-printer control unit applies a preparation bias for transferring a toner image onto a sheet to the transfer unit 206 (A4). Then, the laser-printer control unit causes the charging unit 202 to apply a primary charging bias to the surface of the photosensitive element 201 to charge the surface (A5). When the charged surface of the photosensitive element 201 reaches the developing unit 204, the laser-printer control unit causes the developing unit 204 to apply a primary developing bias to toner to charge the toner (A6). Then, the laser-printer control unit causes the charging unit 202 to apply a secondary charging bias to the surface of the photosensitive element 201, for example, 50 milliseconds after applying the primary charging bias for stabilizing the voltage (A7). Then, in the similar manner, the laser-printer control unit causes the developing unit 204 to apply a secondary developing bias to the toner, for example, 50 milliseconds after applying the primary developing bias for stabilizing the voltage (A8). When the entire surface of the photosensitive element 201 is charged with the secondary charging bias applied by the charging unit 202, i.e., when the photosensitive element 201 rotates one revolution after the start of the charging with the secondary charging bias, the image forming unit 200 is ready for printing (A9).

In the present embodiment, the starting process is classified into five stages: the operation A1, the operation A2, the operation A3, the operation A4, and the operations A5 to A9, and is performed in a stepwise manner in accordance with the stages.

The printing process of the image forming unit 200 is explained.

For printing after starting up the image forming unit 200, the laser-printer control unit causes the exposing unit 203 to expose the charged surface of the photosensitive element 201 thereby forming a latent image thereon, and causes toner to adhere to the latent image by the developing unit 204 thereby forming a toner image. The toner image on the photosensitive element 201 is transferred by the transfer unit 206 onto a sheet conveyed by the sheet conveying unit 205. At this time, toner which is not transferred onto the sheet and remains on the photosensitive element 201 is removed from the photosensitive element 201 by the cleaning unit 207. Thereafter, the laser-printer control unit causes the neutralization unit 208 to neutralize the surface of the photosensitive element 201, so that the potential of the surface becomes zero to be ready for the next latent image formation. The neutralization of the surface of the photosensitive element 201 is performed by the neutralization unit 208 for the size of the sheet. The laser-printer control unit performs the above process for the required number of sheets. Upon completing the printing process, the laser-printer control unit shuts down the image forming unit 200.

The stopping process of the image forming unit 200 is explained with reference to FIG. 3.

First, the laser-printer control unit causes the transfer unit 206 to stop applying the preparation bias. The laser-printer control unit does not move to the next operation (B2) until the application of the preparation bias is completely stopped (B1). Then, the laser-printer control unit changes the output of the charging unit 202 to the primary charging bias (B2). When the surface of the photosensitive element 201 charged with the primary charging bias reaches the developing unit 204, the laser-printer control unit changes the output of the developing unit 204 to the primary developing bias (B3). Then, the laser-printer control unit causes the charging unit 202 to stop applying the primary charging bias, for example, 50 milliseconds after changing the output of the charging unit 202 to the primary charging bias for stabilizing the voltage (B4). Then, in the similar mariner, the laser-printer control unit causes the developing unit 204 to stop applying the primary developing bias, for example, 50 milliseconds after changing the output of the developing unit 204 to the primary developing bias for stabilizing the voltage. Consequently, the photosensitive element 201 and the toner both are not charged (B5). Then, the laser-printer control unit causes the neutralization unit 208 to continue neutralizing the photosensitive element 201 until the surface of the photosensitive element 201 to which the charging unit 202 has stopped applying the primary charging bias reaches the neutralization unit 208, and thereafter stops driving of the neutralization unit 208 (B6). Then, the laser-printer control unit waits until the surface of the photosensitive element 201 to which the developing unit 204 has stopped applying the primary developing bias reaches the cleaning unit 207, and thereafter moves to the next operation (B8) (B7). The laser-printer control unit stops driving of the photosensitive element 201. The laser-printer control unit does not move to the next operation (B9) until the driving of the photosensitive element 201 is completely stopped (B8). Then, the laser-printer control unit stops driving of the polygon mirror. When the driving of the polygon mirror is completely stopped, the stopping process is completed (B9).

In the present embodiment, the stopping process of the image forming unit 200 is classified into six stages: the operation B1, the operations B2 to B5, the operation B6, the operation B7, the operation B8, and the operation B9, and is performed in a stepwise manner in accordance with the stages.

In the present embodiment, in the operations A5 to A9 and the operations B2 to B5, each of the charging unit 202 and the developing unit 204 applies the bias in two steps and waits 50 milliseconds between the two steps because the rising characteristics of the both biases are different.

Specifically, if each of the charging unit 202 and the developing unit 204 applies a target voltage in one step, time difference occurs between the charging unit 202 and the developing unit 204 to reach the target voltage. Consequently, imbalance occurs between the charging bias and the developing bias, which may result in adhering developer containing toner to the surface of the photosensitive element 201. On the other hand, in the present embodiment, each of the charging unit 202 and the developing unit 204 applies the target voltage in two steps, so that the time difference that may occur between the charging unit 202 and the developing unit 204 is reduced. The image forming unit repeats the above printing operation.

Figure 4:
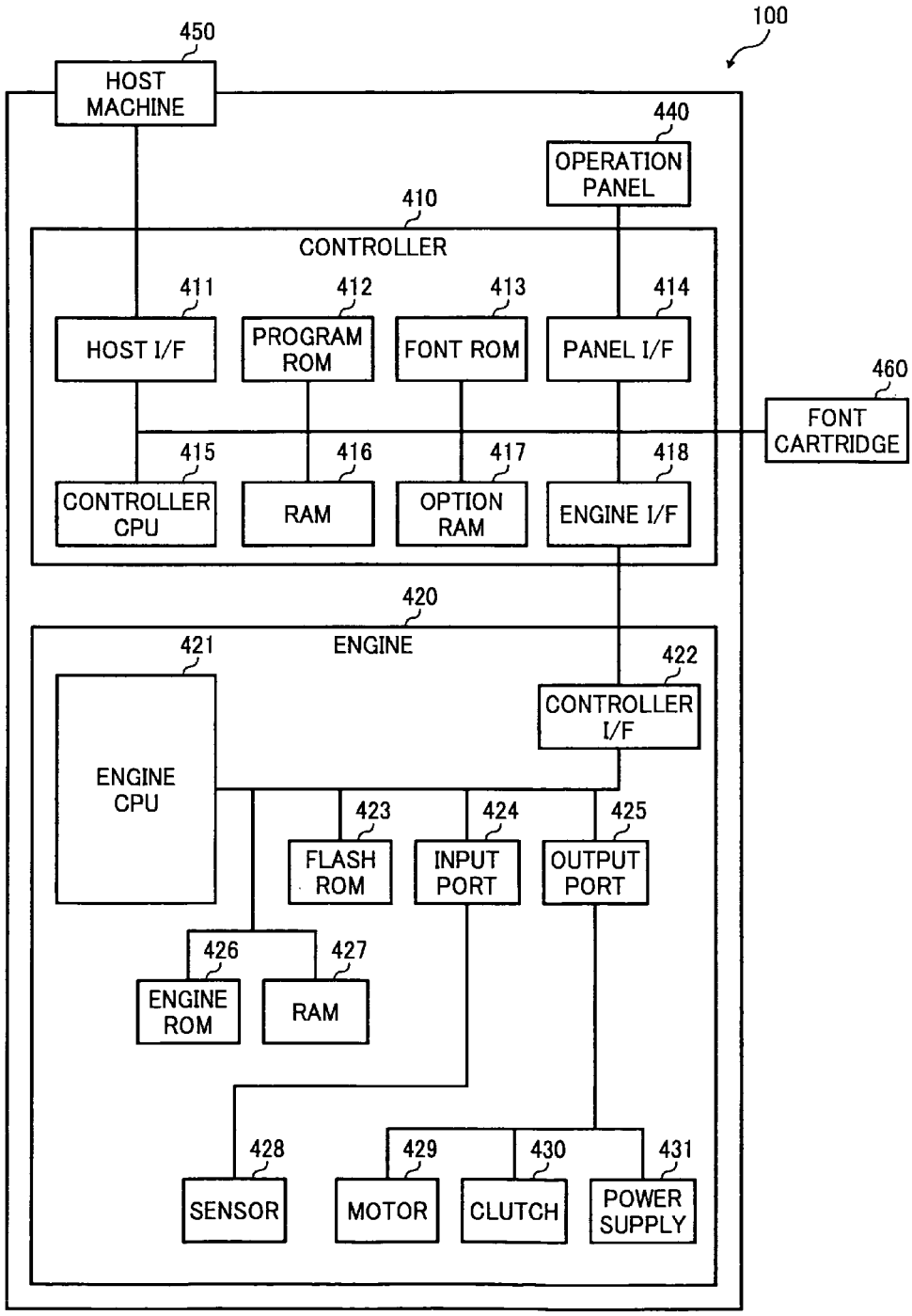
FIG. 4 is a block diagram of a laser-printer control unit of the laser printer.

FIG. 4 is a block diagram of the laser-printer control unit of the laser printer 100.

The laser printer 100 includes a controller 410 that performs interface control with a host machine 450 and controls editing image data and an engine 420 that controls the start-up, the printing process, and the shutdown of the image forming unit 200.

The host machine 450 is a general-purpose computer and transmits/receives data to/from the laser printer 100 in accordance with various operations by a user.

The controller 410 includes a host interface (host I/F) 411, a program read only memory (ROM) 412, a font ROM 413, a panel I/F 414, a controller central processing unit (CPU) 415, a random access memory (RAM) 416, an option RAM 417, and an engine I/F 418. Furthermore, the controller 410 is connected to the host machine 450 via the host I/F 411, to an operation panel 440 via the panel I/F 414, and to a font cartridge 460 that stores various fonts.

The host I/F 411 performs interface control with the host machine 450. The program ROM 412 stores computer programs for editing image data and controlling the controller 410. The font ROM 413 stores a standard font used in printing. The panel I/F 414 performs interface control with the operation panel 440 to serve as an interface with a user at the operation panel 440.

The controller CPU 415 controls the controller 410 by controlling data transmission/reception to/from the host machine 450 and the like through executing various computer programs stored in the program ROM 412. Each of the RAMs 416 and 417 is a memory in which computer programs for processing and control, image data, and the like are loaded. The engine I/F 418 is an interface between the controller 410 and the engine 420.

The engine 420 includes an engine CPU 421, a controller I/F 422, a flash ROM 423, an input port 424, an output port 425, an engine ROM 426, a RAM 427, a sensor 428, a motor 429, a clutch 430, and a power supply 431.

The sensor 428 detects setting conditions for the printing process, abnormality in the image forming unit 200, and the like. The motor 429 includes a main motor for rotating the polygon mirror of the exposing unit 203 and the photosensitive element 201 and a conveying motor for rotating sheet feeding rollers of the sheet conveying unit 205. The clutch 430 drives and stops driving of the sheet feeding rollers and the like. The power supply 431 supplies power necessary for applying bias by the charging unit 202, the developing unit 204, and the transfer unit 206, driving the neutralization unit 208, and the like, to the charging unit 202, the developing unit 204, the transfer unit 206, the neutralization unit 208, and the like. For example, the power supply 431 is a commercial power.

The flash ROM 423 stores therein various computer programs and data. The input port 424 performs an input process of inputting the setting conditions for the printing process, the state of the image forming unit 200, and the like detected by the sensor 428. The output port 425 performs an output processing for realizing the starting process, the printing process, and the stopping process of the image forming unit 200. The engine ROM 426 stores therein computer programs for controlling engines. The RAM 427 has a function of a buffer register and is used as a working memory.

The engine CPU 421 controls the starting process, the printing process, and the stopping process by executing control programs stored in the engine ROM 426. The controller I/F 422 performs interface control with the controller 410 via the engine I/F 418.

A storage medium for storing the control programs is not limited to the engine ROM 426, and a semiconductor storage unit, an optical and/or magnetic storage unit, and the like can also be used. It is possible to use the storage medium for storing such control programs in an external system different from the above, and execute the control programs in a CPU in the external system, whereby an advantage substantially the same as that of the present embodiment can be obtained.

Figure 5:
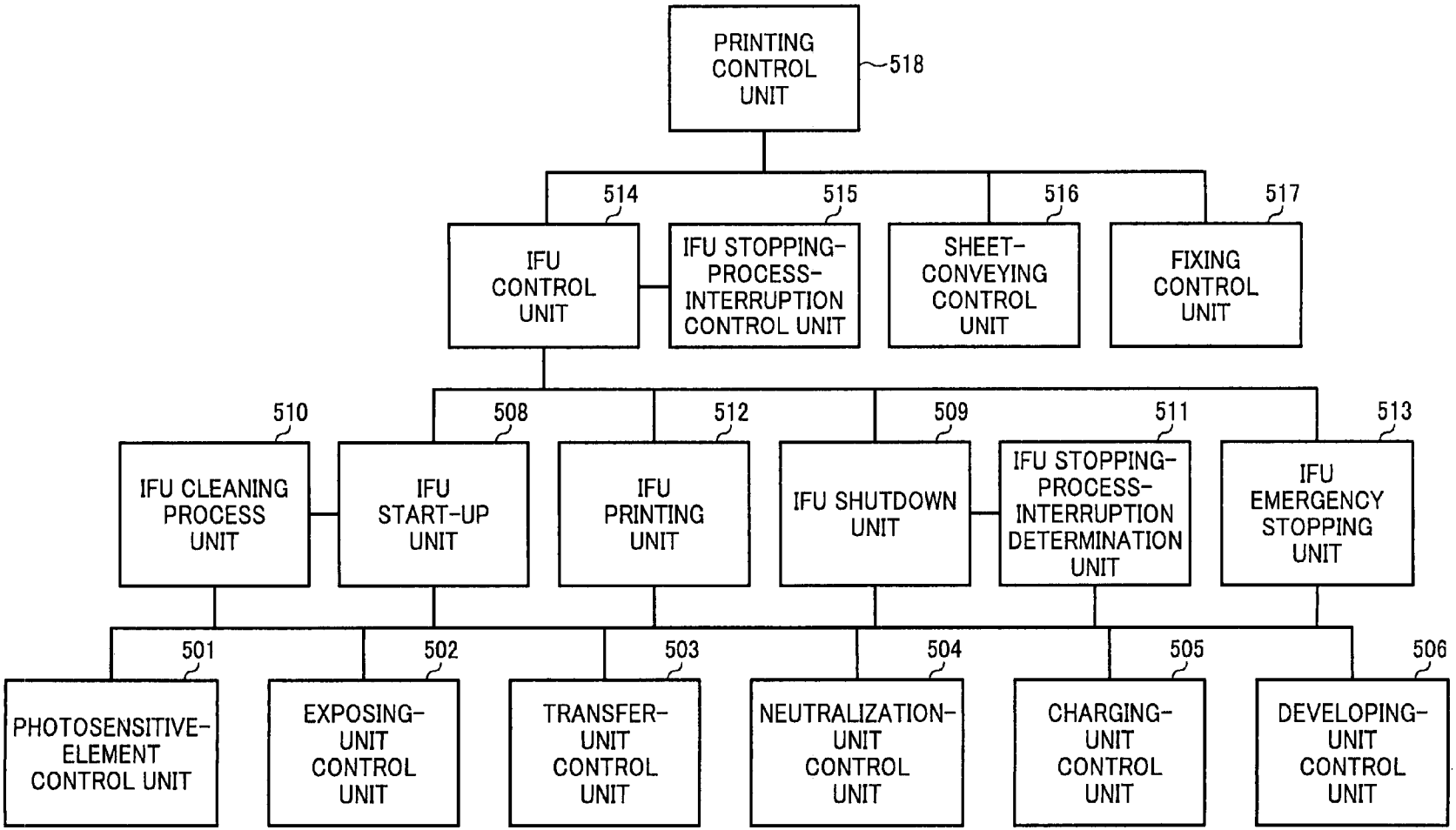
FIG. 5 is a block diagram of control modules for controlling the image forming unit.

Control modules of the image forming unit 200 are explained with reference to FIG. 5. The control modules are realized by the engine CPU 421 executing the control programs stored in the engine ROM 426. FIG. 5 is a block diagram of the control modules for controlling the image forming unit 200. The control modules include a photosensitive-element (driving unit) control unit 501, an exposing-unit control unit 502, a transfer-unit control unit 503, a neutralization-unit control unit 504, a charging-unit control unit 505, and a developing-unit control unit 506 for performing the printing process by the units in the image forming unit 200 such as the photosensitive element 201 and the exposing unit 203 and the stepwise stating process and stopping process of the units in the image forming unit 200. Moreover, the control modules include an image-forming-unit (IFU) start-up unit 508 and an IFU shutdown unit 509 for instructing the above modules to sequentially perform the starting process and the stopping process. In the explanation below that is common to all of the photosensitive-element control unit 501, the exposing-unit control unit 502, the transfer-unit control unit 503, the neutralization-unit control unit 504, the charging-unit control unit 505, and the developing-unit control unit 506, they are referred to as the control units 501 to 506.

The control modules further include an IFU cleaning process unit 510, an IFU stopping-process-interruption determination unit 511, an IFU printing unit 512, an IFU emergency stopping unit 513, an IFU control unit 514, an IFU stopping-process-interruption control unit 515, a sheet-conveying control unit 516, a fixing control unit 517, and a printing control unit 518.

The IFU cleaning process unit 510 causes the cleaning unit 207 to remove residual toner on the photosensitive element 201. The IFU stopping-process-interruption determination unit 511 determines whether the stopping process being performed can be interrupted. The IFU printing unit 512 instructs the control units 501 to 506 to perform the printing process. The IFU emergency stopping unit 513 urgently stops the stopping process. The IFU control unit 514 controls the image forming unit 200. The IFU stopping-process-interruption control unit 515 instructs the IFU printing unit 512, the IFU start-up unit 508, and the IFU shutdown unit 509 to perform the printing process, the starting process, and the stopping process, in accordance with a printing process instruction. The sheet-conveying control unit 516 controls conveying of sheets by the sheet feeding unit 150. The fixing control unit 517 controls a fixing unit (not shown) of the finisher unit 140. The printing control unit 518 sends an operation instruction to the IFU control unit 514, the sheet-conveying control unit 516, and the fixing control unit 517.

When the image forming unit 200 receives the printing process instruction while performing the stopping process, the image forming unit 200 needs to shift to the printing process as soon as possible. Therefore, the IFU stopping-process-interruption determination unit 511 interrupts the stopping process and controls to perform the starting process again.

Figure 6A:
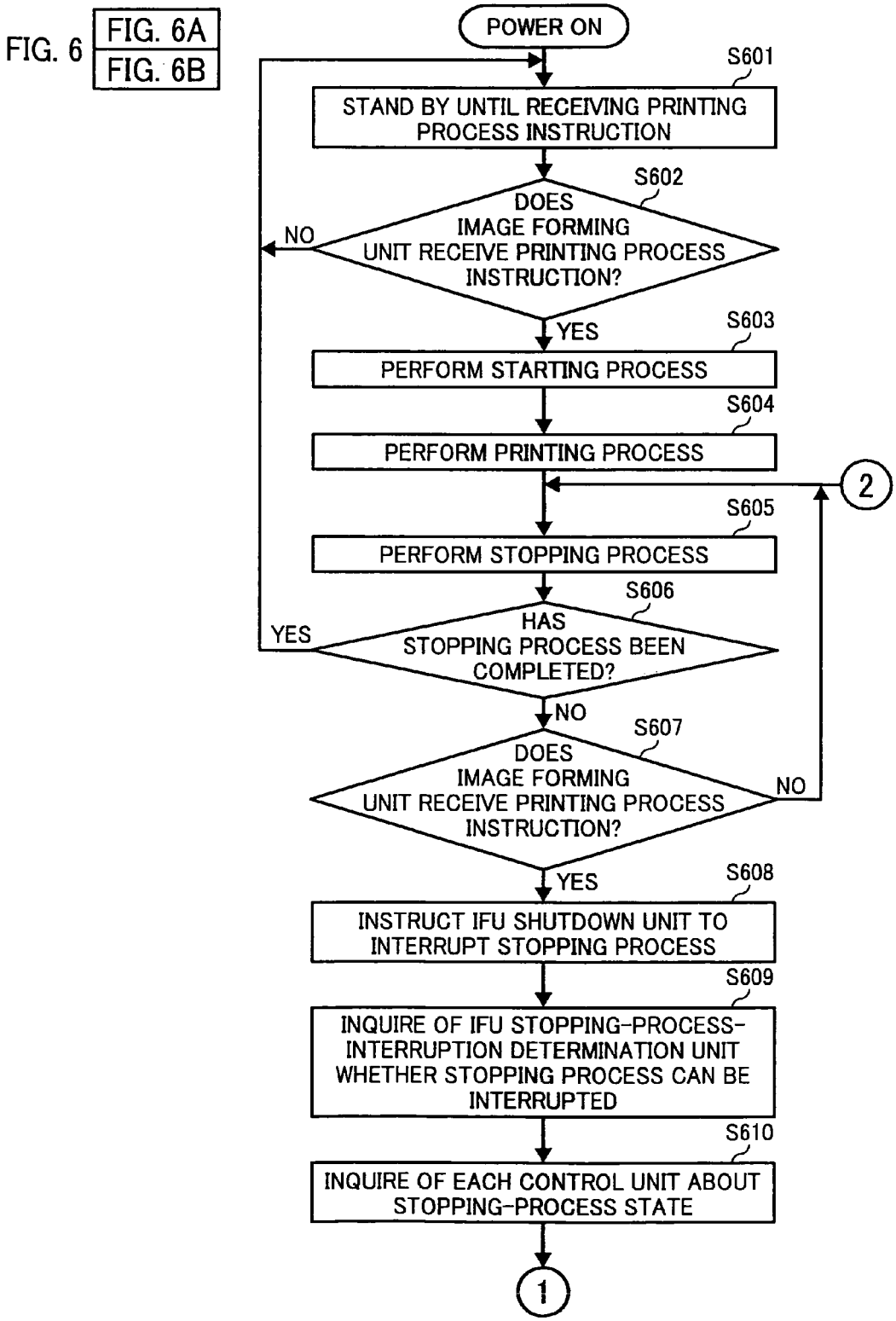
FIG. 6 is a flowchart of a printing process, a starting process, and a stopping process of the image forming unit by the control modules.
Figure 6B:
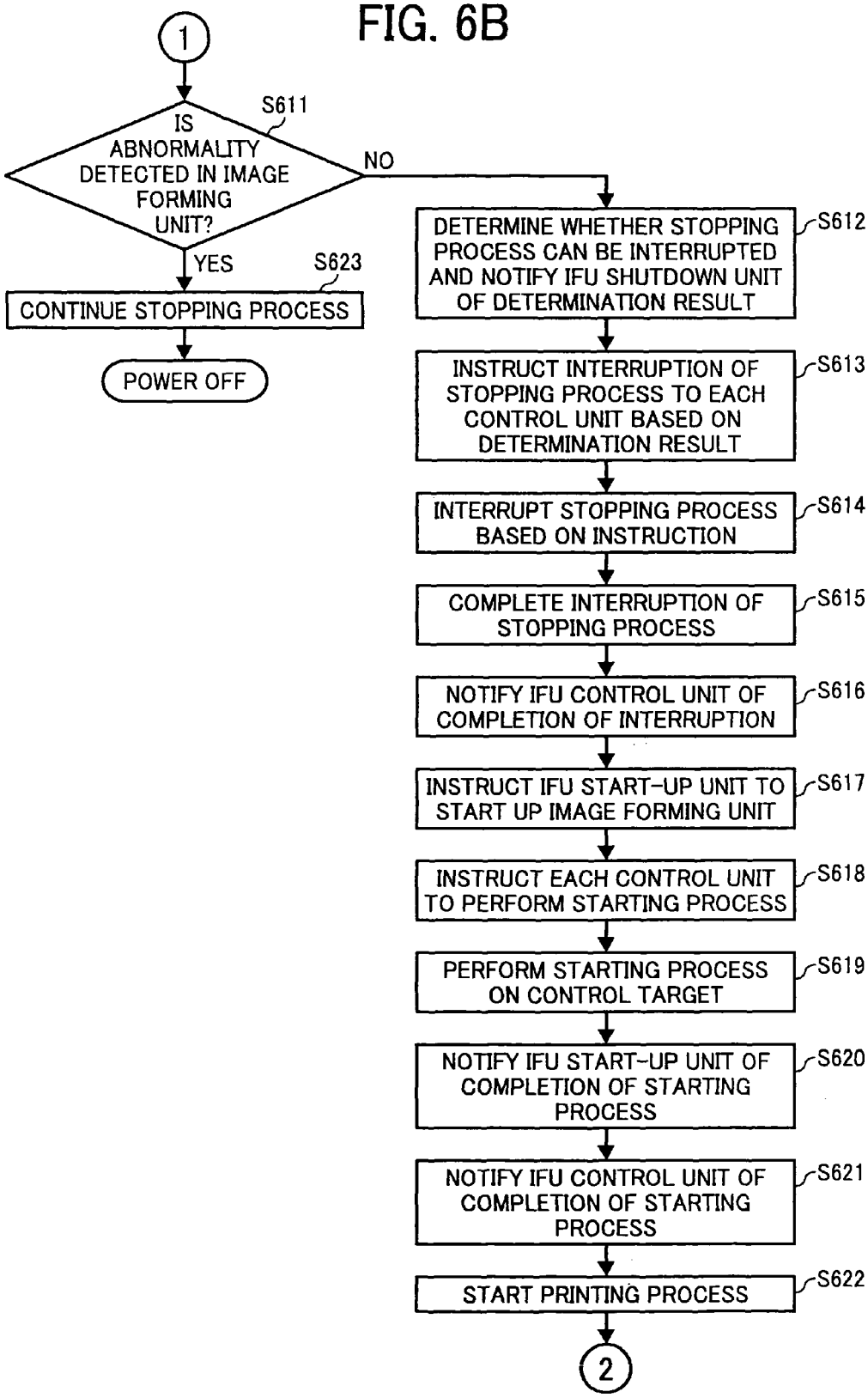

The printing process, the starting process, and the stopping process of the image forming unit 200 by the control modules are explained in detail with reference to FIG. 6. FIG. 6 is a flowchart of the printing process, the starting process, and the stopping process by the control modules.

When the laser printer 100 is turned on, the IFU stopping-process-interruption control unit 515 stands by until receiving the printing process instruction from the controller 410 via the controller I/F 422 (Step S601). When the IFU stopping-process-interruption control unit 515 receives the printing process instruction from the controller 410 (YES at Step S602), the IFU stopping-process-interruption control unit 515 instructs the IFU start-up unit 508 to perform the starting process, and the IFU start-up unit 508 instructs each of the control units 501 to 506 to perform the starting process in a stepwise manner (A1 to A9 shown in FIG. 3) in response to the instruction (Step S603).

When the starting process is completed, the IFU stopping-process-interruption control unit 515 instructs the IFU printing unit 512 to perform the printing process, and the IFU printing unit 512 instructs each of the control units 501 to 506 to perform the printing process in response to the instruction (Step S604).

When the printing process is completed, the IFU stopping-process-interruption control unit 515 instructs the IFU shutdown unit 509 to perform the stopping process, and the IFU shutdown unit 509 instructs each of the control units 501 to 506 to perform the stopping process in a stepwise manner (B1 to B9 shown in FIG. 3) in response to the instruction (Step S605). In the stopping process, the IFU stopping-process-interruption control unit 515 checks whether the stopping process is completed (Step S606). If the stopping process is completed (YES at Step S606), the system control returns to Step S601 and the IFU stopping-process-interruption control unit 515 stands by until receiving the printing process instruction from the controller 410 again.

On the other hand, if the IFU stopping-process-interruption control unit 515 receives the printing process instruction from the controller 410 (YES at Step S607) while the stopping process is not completed (NO at Step S606), the IFU stopping-process-interruption control unit 515 instructs the IFU shutdown unit 509 to interrupt the stopping process (Step S608). The IFU shutdown unit 509 inquires of the IFU stopping-process-interruption determination unit 511 whether the currently-performed stopping process can be interrupted (Step S609).

The IFU stopping-process-interruption determination unit 511 inquires of each of the control units 501 to 506 about the state of the stopping process (Step S610). Moreover, the IFU stopping-process-interruption determination unit 511 detects whether there is an abnormality in the laser printer 100 by the sensor 428 (Step S611). If there is an abnormality in the laser printer 100 (YES at Step S611), the IFU emergency stopping unit 513 instructs the control units 501 to 506 to continue the stopping process (Step S623), so that the control units 501 to 506 continue the stopping process regardless of the printing process instruction. If there is no abnormality in the laser printer 100 (NO at Step S611), the IFU stopping-process-interruption determination unit 511 specifies the stage of the stopping process being performed based on the state of the stopping process received from the control units 501 to 506, determines whether the stopping process can be interrupted in accordance with the specified stage, and notifies the IFU shutdown unit 509 of the result of the determination (Step S612).

An operation to be performed in accordance with the result of the determination is explained for each stage specified by the IFU stopping-process-interruption determination unit 511.

If the IFU stopping-process-interruption control unit 515 instructs to interrupt the stopping process, i.e., receives the printing process instruction, in the operation B1 shown in FIG. 3, the IFU stopping-process-interruption determination unit 511 determines that the operation B1 can be interrupted because no problem (abnormality) will occur due to the interruption of the stopping process of the transfer unit 206. Thereafter, only the operation A4 is performed.

If the IFU stopping-process-interruption control unit 515 instructs to interrupt the stopping process in the operations B2 to B5 shown in FIG. 3, the IFU stopping-process-interruption determination unit 511 determines that the stopping process of the charging unit 202 and the developing unit 204 cannot be interrupted because developer (toner) may adhere to the photosensitive element 201 due to the interruption of the stopping process of the charging unit 202 and the developing unit 204 resulting in abnormality of the laser printer 100. Thereafter, when the operations B2 to B5 are completed, the operations A4 to A9 are performed.

If the IFU stopping-process-interruption control unit 515 instructs to interrupt the stopping process in the operation B6 shown in FIG. 3, the IFU stopping-process-interruption determination unit 511 determines that the operation B6 can be interrupted because no problem will occur due to the interruption of the stopping process of the neutralization unit 208. Thereafter, only the operations A4 to A9 are performed.

If the IFU stopping-process-interruption control unit 515 instructs to interrupt the stopping process in the operation B8 shown in FIG. 3, the IFU stopping-process-interruption determination unit 511 determines that the stopping process of the photosensitive element 201 cannot be interrupted because the rotation of the photosensitive element 201 may become unstable resulting in abnormality of the laser printer 100. Thereafter, when the operation B8 is completed, the operations A2 to A9 are performed.

If the IFU stopping-process-interruption control unit 515 instructs to interrupt the stopping process in the operation B9 shown in FIG. 3, the IFU stopping-process-interruption determination unit 511 determines that the operation B9 can be interrupted because no problem will occur due to the interruption of the stopping process of the polygon mirror. Thereafter, the operations A1 to A9 are performed. At this time, the polygon mirror rotates by its rotational inertia, so that polygon mirror comes to rotate stably in a shorter time than the case of driving the polygon mirror in a stopped state.

Accordingly, the printing process can be started earlier than the case of starting the laser printer 100 after the stopping process is completely finished.

The IFU shutdown unit 509 instructs each of the control units 501 to 506 to interrupt the stopping process during or after the stopping process of the stage specified by the IFU stopping-process-interruption determination unit 511 based on the result of the determination notified from the IFU stopping-process-interruption determination unit 511 (Step S613). Each of the control units 501 to 506 interrupts the stopping process based on the instruction from the IFU shutdown unit 509 (Step S614).

Upon completing interruption of the stopping process (Step S615), the IFU shutdown unit 509 notifies the IFU control unit 514 of the completion of the interruption (Step S616). Then, the IFU stopping-process-interruption control unit 515 instructs the IFU start-up unit 508 to restart the image forming unit 200 (Step S617).

The IFU start-up unit 508 instructs each of the control units 501 to 506 to perform the starting process (the operations A1 to A9 in FIG. 3) (Step S618). In response to the instruction, each of the control units 501 to 506 performs the starting process of a corresponding control target such as the photosensitive element 201 and the charging unit 202 (Step S619). At this time, if the control target is operating, each of the control units 501 to 506 need not restart the control target. Upon completing the starting process (including the case where the control target need not be restarted), the control units 501 to 506 notifies the IFU start-up unit 508 of the completion of the starting process (Step S620).

Accordingly, when the control target such as the photosensitive element 201 and the charging unit 202 is operating, the image forming unit 200 can be started in a shorter time than the case of starting the image forming unit 200 in a completely stopped state.

Upon completing the whole starting process, the IFU start-up unit 508 notifies the IFU control unit 514 of the completion (Step S621), and the IFU stopping-process-interruption control unit 515 instructs the IFU printing unit 512 to perform the printing process to restart printing by the printing control unit 518 (Step S622).

Accordingly, when there is a print instruction during the stopping process, the stopping process is interrupted, so that the time for starting the printing can be shortened.

Moreover, when the stopping process in a specified stage cannot be interrupted, the image forming unit 200 is restarted after completing the stopping process in the specified stage, so that the time for starting the printing can be shortened without causing any trouble in the image forming unit 200.

In the present embodiment, each of the control units 501 to 506 starts the stopping process upon receiving the stopping process instruction from the IFU shutdown unit 509; however, it is not limited thereto. For example, each of the control units 501 to 506 can start the stopping process after standing by for a certain period of time. In this case, when the control units 501 to 506 receive the print instruction while in the standby state, the printing process can be performed promptly.

If an abnormality occurs in the image forming unit 200, the stopping process is continued even if the IFU stopping-process-interruption control unit 515 receives the printing process instruction, so that the image forming unit 200 can be appropriately controlled.

When the stopping process is interrupted after receiving the printing process instruction during the stopping process or standby for the stopping process, the stopping process is restarted after completing the printing process. Therefore, the image forming unit 200 can be controlled efficiently.

A modified example of the first embodiment is explained. In the modified example, the stopping process in each stage is associated with interruption determination information indicating whether it is possible to interrupt the stopping process in each stage that is determined based on an abnormality occurred in the image forming unit 200 by the interruption, which is stored in the engine ROM 426 as a table. It is determined whether the stopping process in a stage specified by the IFU stopping-process-interruption determination unit 511 can be interrupted in accordance with the interruption determination information associated with the specified stage in the table. Only the components different from those of the first embodiment are explained below.

FIG. 7 is a schematic diagram illustrating the table stored in the engine ROM 426 as an example, in which the stopping process in each stage, the interruption determination information, and starting process information are associated with each other. The starting process information indicates whether each unit of the image forming unit 200 needs the starting process when the stopping process is interrupted based on the interruption determination information.

The IFU stopping-process-interruption determination unit 511, after specifying a stage of the stopping process, specifies the interruption determination information associated with the stopping process in the specified stage in FIG. 7. Then, the IFU stopping-process-interruption determination unit 511 determines whether the stopping process in the specified stage can be interrupted based on the specified interruption determination information.

For example, when the IFU stopping-process-interruption determination unit 511 receives the printing process instruction during the standby period before the stopping process is started, the IFU stopping-process-interruption determination unit 511 determines that the stopping process can be interrupted in accordance with "INTERRUPTIBLE" associated with "WAITING FOR SHUTDOWN" in FIG. 7. The IFU start-up unit 508 does not instruct the control units 501 to 506 to perform the starting process because "UNNECESSARY" associated with "WAITING FOR SHUTDOWN" in FIG. 7 indicates that the starting process is not needed.

When the IFU stopping-process-interruption determination unit 511 receives the printing process instruction while the stopping process of the transfer unit 206 is performed, the IFU stopping-process-interruption determination unit 511 determines that the stopping process can be interrupted in accordance with "INTERRUPTIBLE" associated with "STOPPING PROCESS OF TRANSFER UNIT" in FIG. 7. Because "NECESSARY" for the transfer unit 206 that is associated with "STOPPING PROCESS OF TRANSFER UNIT" in FIG. 7 indicates that the starting process is necessary for the transfer unit 206, the IFU start-up unit 508 instructs the transfer-unit control unit 503 to perform the starting process.

When the IFU stopping-process-interruption determination unit 511 receives the printing process instruction while the stopping process of the charging unit 202 is performed, the IFU stopping-process-interruption determination unit 511 determines that the stopping process cannot be interrupted, i.e., the IFU stopping-process-interruption determination unit 511 needs to wait for completion of the stopping process of the charging unit 202, in accordance with "WAITING FOR COMPLETION OF STOPPING PROCESS" associated with "STOPPING PROCESS OF CHARGING UNIT" in FIG. 7. Because "NECESSARY" for the charging unit 202 and the transfer unit 206 that is associated with "STOPPING PROCESS OF CHARGING UNIT" in FIG. 7 indicates that the starting process is necessary for the charging unit 202 and the transfer unit 206, the IFU start-up unit 508 instructs the transfer-unit control unit 503 and the charging-unit control unit 505 to perform the starting process.

According to the modified example, it is determined whether the stopping process in a specified stage can be interrupted by referring to the table shown in FIG. 7, and an advantage the same as that of the first embodiment can be obtained.

In a second embodiment, an image forming unit that includes an image forming unit 800 is provided to the body unit 110. The image forming unit 800 is a tandem color electrophotographic printer that includes an intermediate transfer body. Only the components different from those of the first embodiment are explained below.

Figure 8:
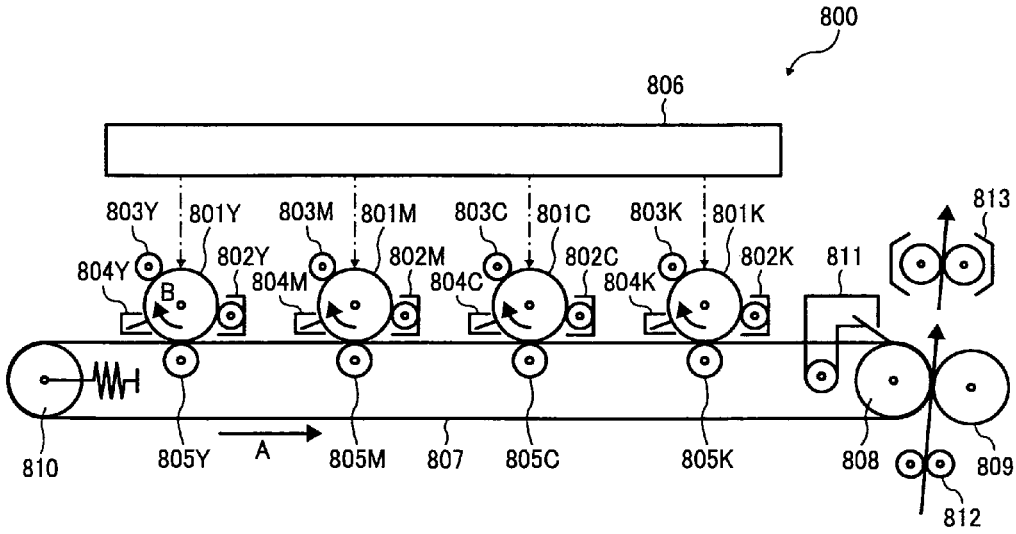
FIG. 8 is a schematic diagram of an image forming unit according to a second embodiment of the present invention.

FIG. 8 is a schematic diagram of the image forming unit 800. The image forming unit 800 includes photosensitive elements 801Y, 801M, 801C, and 801K for four colors of yellow (Y), magenta (M), cyan (C), and black (K), developing units 802Y, 802M, 802C, and 802K, charging units 803Y, 803M, 803C, and 803K, cleaning units 804Y, 804M, 804C, and 804K, intermediate transfer rollers 805Y, 805M, 805C, and 805K, an exposing unit 806, and an intermediate transfer belt 807. The developing units 802Y, 802M, 802C, and 802K develop latent images formed on the photosensitive elements 801Y, 801M, 801C, and 801K into toner images with different colors, respectively. The intermediate transfer belt 807 is an endless belt that rotates in a direction indicated by an arrow A in FIG. 8 and onto which the toner images are primary transferred in a superimposed manner. In the explanation below that is common to all of the photosensitive elements 801Y, 801M, 801C, and 801K, all of the developing units 802Y, 802M, 802C, and 802K, all of the charging units 803Y, 803M, 803C, and 803K, all of the cleaning units 804Y, 804M, 804C, and 804K, all of the intermediate transfer rollers 805Y, 805M, 805C, and 805K, they are referred to as photosensitive elements 801, developing units 802, charging units 803, and cleaning units 804, intermediate transfer rollers 805, respectively.

The photosensitive elements 801 are arranged in a line above the intermediate transfer belt 807 along the direction indicated by the arrow A in FIG. 8. The developing unit 802, the charging unit 803, the cleaning unit 804, and the intermediate transfer roller 805 are provided around the photosensitive element 801.

The photosensitive element 801 is driven to rotate in a direction indicated by an arrow B in FIG. 8, during which the charging unit 803 applies a bias to the photosensitive element 801, whereby the surface of the photosensitive element 801 is uniformly charged. Then, the exposing unit 806 radiates a laser beam to the uniformly charged surface of the photosensitive element 801 to form a latent image thereon. The developing unit 802 develops the latent image into a toner image of a corresponding color.

The intermediate transfer roller 805 is arranged to oppose the photosensitive element 801 with the intermediate transfer belt 807 therebetween, and the intermediate transfer belt 807 is driven to rotate in a state of being nipped between the intermediate transfer roller 805 and the photosensitive element 801. The intermediate transfer belt 807 is supported by a driving roller 808 as a secondary transfer roller and a supporting roller 810. The intermediate transfer belt 807 can be supported by more than two rollers; however, the height of the image forming unit 800 can be suppressed by supporting the intermediate transfer belt 807 by only two rollers, enabling to reduce the size of the image forming unit 800.

The toner images of respective colors on the photosensitive elements 801 are sequentially transferred onto the intermediate transfer belt 807 by the intermediate transfer rollers 805 in a superimposed manner, whereby a full-color toner image is formed on the intermediate transfer belt 807. Thereafter, the cleaning unit 804 cleans the surface of the corresponding photosensitive element 801 to remove residual toner on the surface.

A pair of registration rollers 812 as a sheet-conveying unit conveys a sheet to a portion between the driving roller 808 and a transfer roller 809 as a transfer unit at a predetermined timing. The driving roller 808 and the transfer roller 809 are arranged to oppose each other with the intermediate transfer belt 807 therebetween. When the sheet is conveyed between the driving roller 808 and the transfer roller 809, the full-color toner image on the intermediate transfer belt 807 is collectively transferred onto the sheet by the action of the transfer roller 809. Then, the sheet is conveyed to a fixing unit 813, in which the full-color toner image is fixed to the sheet by heat and pressure. The sheet with the full-color toner image fixed thereto is discharged onto a discharge tray (not shown). Toner remaining on the intermediate transfer belt 807 after transferring the full-color toner image onto the sheet is removed by a cleaning unit 811. The image forming unit 800 includes neutralization units (not shown) each of which is arranged between the cleaning unit 804 and the charging unit 803 to neutralize the surface of the photosensitive element 801.

Figure 9:
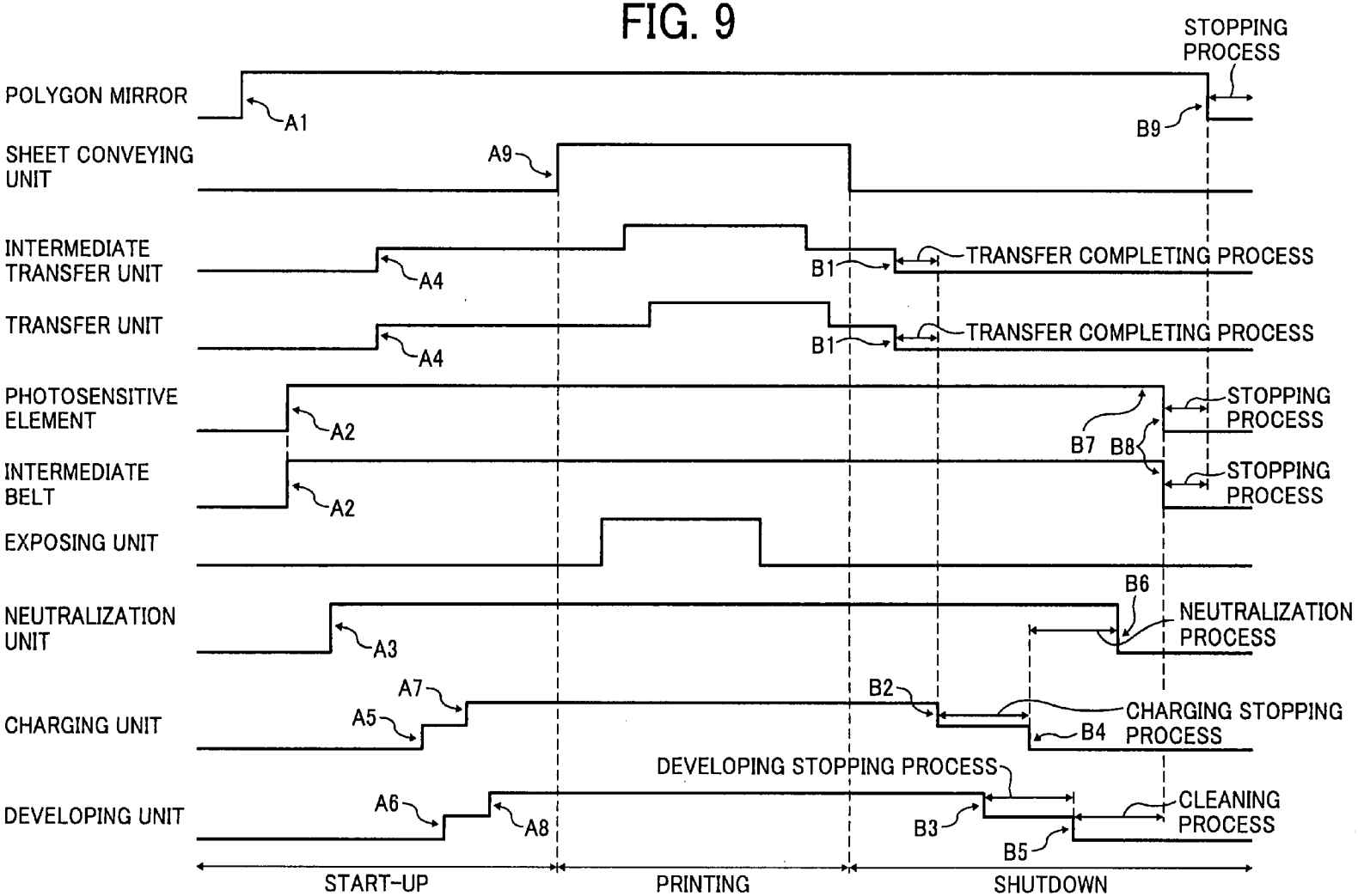
FIG. 9 is a timing chart of a printing operation of the image forming unit.

The procedure and the content of the printing operation of the image forming unit 800 when the image forming unit performs the printing process are explained with reference to FIG. 9. FIG. 9 is a timing chart of the printing operation of the image forming unit 800. When printing is started, the image forming unit starts the printing operation shown in FIG. 9 to cause the image forming unit 800 to be in a printable state. The printing operation is classified into the starting process, the printing process, and the stopping process.

The starting process of the image forming unit 800 is explained with reference to FIG. 9.

First, a laser-printer control unit causes a polygon mirror for exposure (not shown) to rotate stably (A1). Then, the laser-printer control unit drives the photosensitive element 801 and the intermediate transfer belt 807 to rotate stably by the driving unit and the driving roller 808 (A2). Then, the laser-printer control unit drives the neutralization unit (A3). Then, the laser-printer control unit applies a preparation bias for transferring an image to the intermediate transfer roller 805 and the transfer roller 809 (A4). Then, the laser-printer control unit causes the charging unit 803 to apply a primary charging bias to the surface of the photosensitive element 801 to charge the surface (A5). When the charged surface of the photosensitive element 801 reaches the developing unit 802, the laser-printer control unit causes the developing unit 802 to apply a primary developing bias to toner to charge the toner (A6). Then, the laser-printer control unit causes the charging unit 803 to apply a secondary charging bias to the surface of the photosensitive element 801, for example, 50 milliseconds after applying the primary charging bias for stabilizing the voltage (A7). Then, in the similar manner, the laser-printer control unit causes the developing unit 802 to apply a secondary developing bias to the toner, for example, 50 milliseconds after applying the primary developing bias for stabilizing the voltage (A8). When the entire surface of the photosensitive element 801 is charged with the secondary charging bias applied by the charging unit 803, i.e., when the photosensitive element 801 rotates one revolution after the start of the charging with the secondary charging bias, the image forming unit 800 is ready for printing (A9).

In the present embodiment, the starting process is classified into five stages: the operation A1, the operation A2, the operation A3, the operation A4, and the operations A5 to A9, and is performed in a stepwise manner in accordance with the stages.

The printing process of the image forming unit 800 is explained.

For printing after starting up the image forming unit 800, the laser-printer control unit causes the exposing unit 806 to expose the charged surfaces of the photosensitive elements 801 thereby forming a latent image on each of the photosensitive elements 801, and causes toner to adhere to the latent image by each of the developing units 802 thereby forming a toner image. The toner images on the photosensitive elements 801 are transferred onto the intermediate transfer belt 807 by the intermediate transfer rollers 805 to form a full-color toner image on the intermediate transfer belt 807. At this time, toner which is not transferred onto the intermediate transfer belt 807 and remains on the photosensitive elements 801 is removed from the photosensitive elements 801 by the cleaning units 804. Thereafter, the full-color toner image on the intermediate transfer belt 807 is conveyed to the transfer roller 809 to be transferred onto a sheet conveyed by the registration rollers 812. The laser-printer control unit causes the neutralization units to neutralize the surfaces of the photosensitive elements 801, so that the potential of the surface of each of the photosensitive elements 801 becomes zero to be ready for the next latent image formation. The neutralization of the surface of each of the photosensitive elements 801 is performed by the neutralization unit for the size of the sheet. The laser-printer control unit performs the above process for the required number of sheets. Upon completing the printing process, the laser-printer control unit shuts down the image forming unit 800.

The stopping process of the image forming unit 800 is explained with reference to FIG. 9.

First, the laser-printer control unit causes the intermediate transfer roller 805 and the transfer roller 809 to stop applying the preparation bias. The laser-printer control unit does not move to the next operation (B2) until the application of the preparation bias is completely stopped (B1). Then, the laser-printer control unit changes the output of the charging unit 803 to the primary charging bias (B2). When the surface of the photosensitive element 801 charged with the primary charging bias reaches the developing unit 802, the laser-printer control unit changes the output of the developing unit 802 to the primary developing bias (B3). Then, the laser-printer control unit causes the charging unit 803 to stop applying the primary charging bias, for example, 50 milliseconds after changing the output of the charging unit 803 to the primary charging bias for stabilizing the voltage (B4). Then, in the similar manner, the laser-printer control unit causes the developing unit 802 to stop applying the primary developing bias, for example, 50 milliseconds after changing the output of the developing unit 802 to the primary developing bias for stabilizing the voltage. Consequently, the photosensitive element 801 and the toner both are not charged (B5). Then, the laser-printer control unit causes the neutralization unit to continue neutralizing the photosensitive element 801 until the surface of the photosensitive element 801 to which the charging unit 803 has stopped applying the primary charging bias reaches the neutralization unit, and thereafter stops driving of the neutralization unit (B6). Then, the laser-printer control unit waits until the surface of the photosensitive element 801 to which the developing unit 802 has stopped applying the primary developing bias reaches the cleaning unit 804, and thereafter moves to the next operation (B8) (B7). The laser-printer control unit stops driving of the photosensitive element 801 and the intermediate transfer belt 807. The laser-printer control unit does not move to the next operation (B9) until the driving of the photosensitive element 801 is completely stopped (B8). Then, the laser-printer control unit stops driving of the polygon mirror. When the driving of the polygon mirror is completely stopped, the stopping process is completed (B9).

In the present embodiment, the stopping process of the image forming unit 800 is classified into six stages: the operation B1, the operations B2 to B5, the operation B6, the operation B7, the operation B8, and the operation B9, and is performed in a stepwise manner in accordance with the stages.

Figure 10:
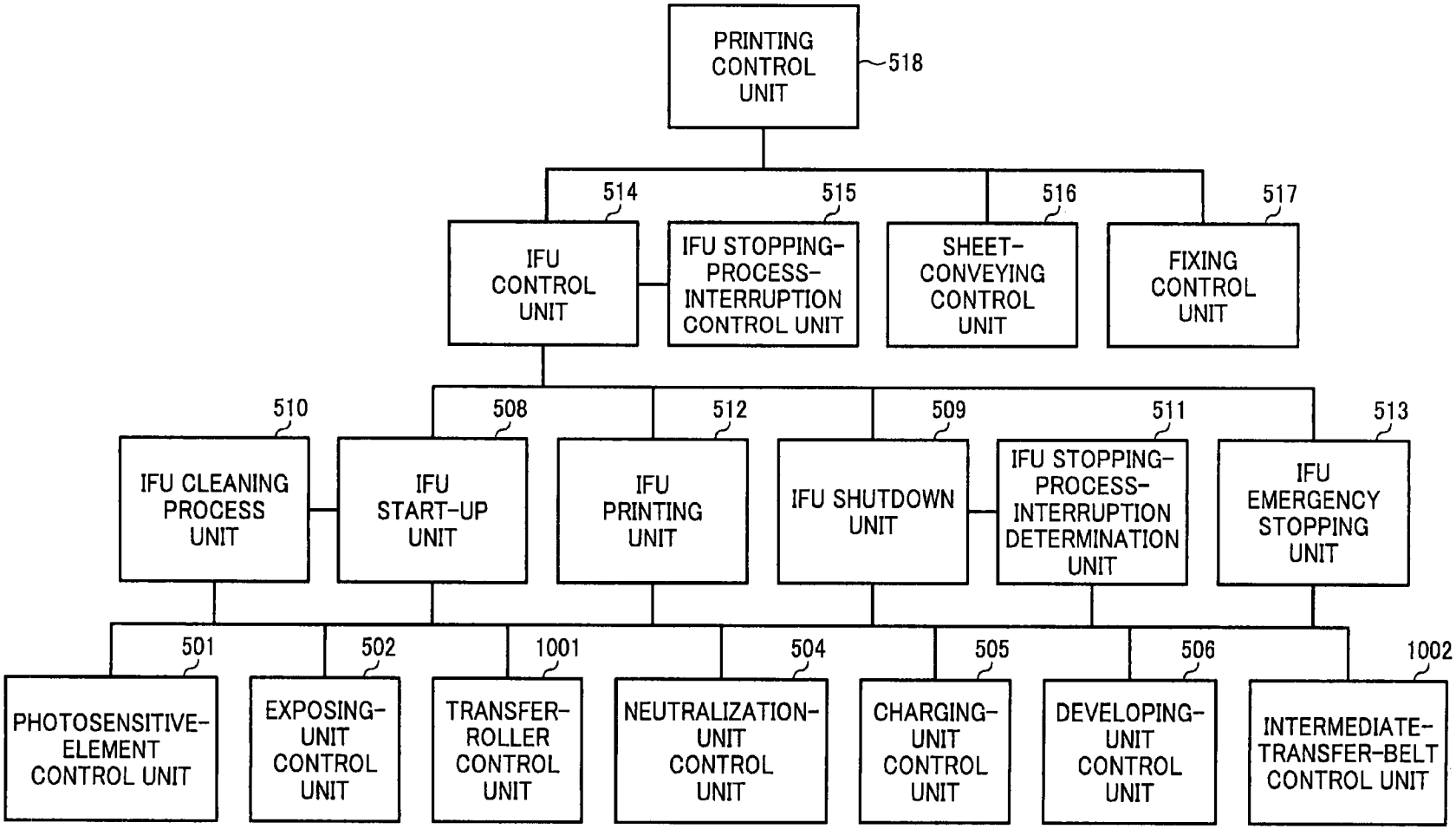
FIG. 10 is a block diagram of control modules for controlling the image forming unit.
Figure 11:
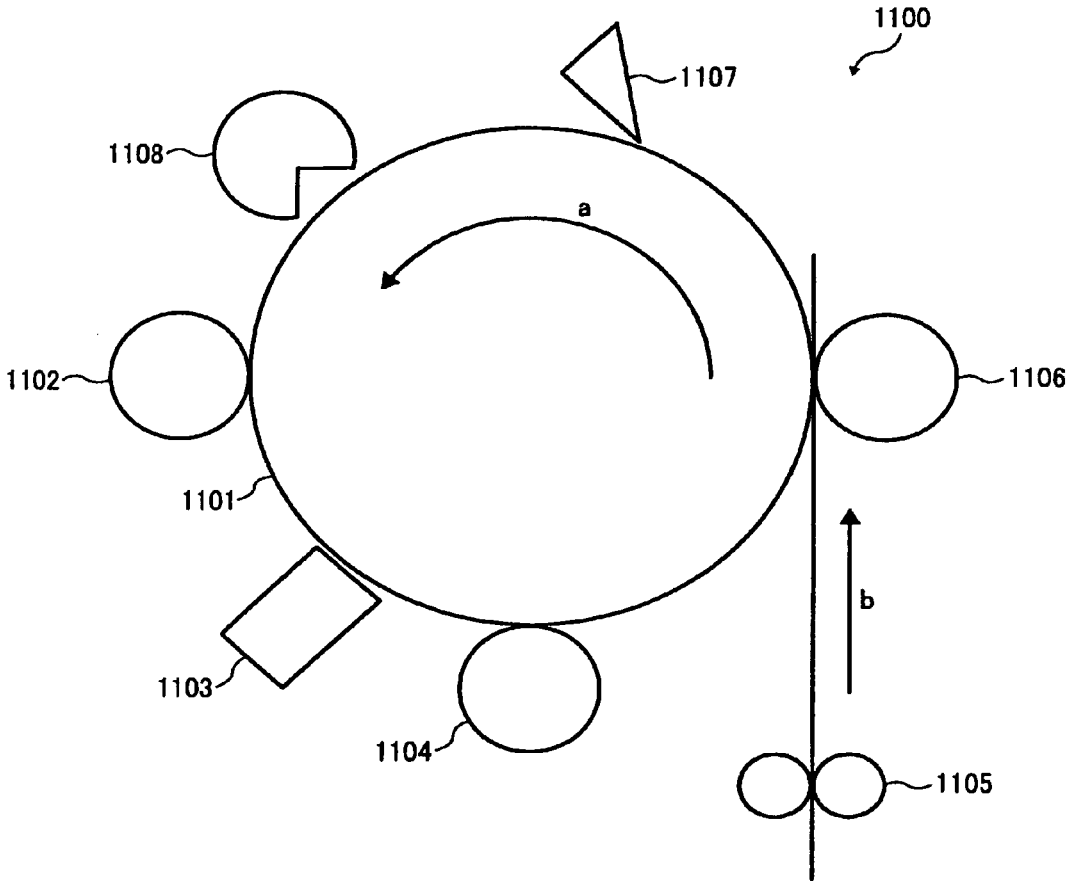
RELATED ART FIG. 11
FIG. 11 is a schematic diagram of a conventional image forming unit for an electrophotographic printer.

Control modules of the image forming unit 800 are explained with reference to FIG. 10. The control modules are realized by the engine CPU 421 executing the control programs stored in the engine ROM 426. FIG. 10 is a block diagram of the control modules for controlling the image forming unit 800. The configuration of the control modules is the same as that in the first embodiment except that a transfer-roller control unit 1001 for controlling the intermediate transfer roller 805 and the transfer roller 809 is provided instead of the transfer-unit control unit 503, and an intermediate-transfer-belt control unit 1002 for controlling driving of the intermediate transfer belt 807 by the driving roller 808 is added.

The flow of each of the printing process, the starting process, and the stopping process in the image forming unit 800 by the control modules is the same as that in the flowchart of FIG. 6 in the first embodiment, so that explanation thereof is omitted.

According to the present embodiment, even when the image forming unit that includes the image forming unit 800 as a color electrophotographic printer is provided to the body unit 110, an advantage the same as that of the first embodiment can be obtained.

According to one aspect of the present invention, even when an image forming process instruction was received in the stopping process, a stopping process can be interrupted and a starting process can be restarted. Thus, printing can be performed corresponding to the instruction promptly.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image forming unit that performs an image forming process;

a control unit that controls a starting process and a stopping process of the image forming unit in a stepwise manner;

a determination unit that, upon receiving an instruction for executing the image forming process during the stopping process, inquires of the control unit about a stage of the stopping process and determines whether the stopping process in the stage is interruptible;

a shutdown unit that instructs the control unit to interrupt the stopping process during or after the stage, based on a result of determination by the determination unit; and a start-up unit that instructs the control unit to perform the starting process after interrupting the stopping process.

2. The image forming apparatus according to claim 1, further comprising:

a storing unit that stores therein data in which the stopping process in each stage is associated with interruption determination information indicating whether the stopping process is interruptible at each stage determined based on an abnormality that is to occur in the image forming unit by interrupting the stopping process, wherein the determination unit determines whether the stopping process at each stage is interruptible, based on the data stored in the storing unit.

3. The image forming apparatus according to claim 1, wherein the image forming unit includes an image carrier on which a toner image is formed, a charging unit that charges the image carrier, an exposing unit that forms a latent image on the image carrier by exposing the image carrier charged by the charging unit, a developing unit that causes toner to adhere to the latent image to form a toner image on the image carrier, a transfer unit that transfers the toner image onto a sheet, a neutralization unit that neutralizes the image carrier charged by the charging unit, and a removing unit that removes toner remaining on the image carrier after the toner image is transferred onto the sheet, and when the stopping process at a stage specified by the determination unit is for stopping any one of the exposing unit, the transfer unit, the neutralization unit, and the removing unit, the determination unit determines that the stopping process is interruptible.

4. The image forming apparatus according to claim 1, wherein the image forming unit includes an image carrier on which a toner image is formed, a driving unit that drives the image carrier, a charging unit that charges the image carrier, an exposing unit that forms a latent image on the image carrier by exposing the image carrier charged by the charging unit, and a developing unit that causes toner to adhere to the latent image to form a toner image on the image carrier, and when the stopping process at a stage specified by the determination unit is for stopping any one of the charging unit, the developing unit, and the driving unit, the determination unit determines that the stopping process is not interruptible.

5. The image forming apparatus according to claim 1, further comprising:

a detecting unit that detects an abnormality of the image forming apparatus, wherein when the detecting unit detects the abnormality, the control unit continues the stopping process regardless of the instruction for executing the image forming process.

6. The image forming apparatus according to claim 1, wherein when instructed by the start-up unit to perform the starting process, the control unit performs the starting process at a stage in which the stopping process is not performed.

7. A control method for an image forming apparatus including an image forming unit that performs an image forming process, the control method comprising:

controlling a starting process and a stopping process of the image forming unit in a stepwise manner;

determining, upon receiving an instruction for executing the image forming process during the stopping process, including inquiring about a stage of the stopping process, and determining whether the stopping process in the stage is interruptible;

shutting-down including instructing to interrupt the stopping process during or after the stage, based on a result of determination at the determining; and starting-up including instructing to perform the starting process after interrupting the stopping process.

8. The control method according to claim 7, wherein the image forming apparatus further includes a storing unit that stores therein data in which the stopping process in each stage is associated with interruption determination information indicating whether the stopping process is interruptible at each stage determined based on an abnormality that is to occur in the image forming unit by interrupting the stopping process, and the determining further includes determining whether the stopping process at each stage is interruptible, based on the data stored in the storing unit.

9. The control method according to claim 7, wherein the image forming unit further includes an image carrier on which a toner image is formed, a charging unit that charges the image carrier, an exposing unit that forms a latent image on the image carrier by exposing the image carrier charged by the charging unit, a developing unit that causes toner to adhere to the latent image to form a toner image on the image carrier, a transfer unit that transfers the toner image onto a sheet, a neutralization unit that neutralizes the image carrier charged by the charging unit, and a removing unit that removes toner remaining on the image carrier after the toner image is transferred onto the sheet, and when the stopping process at a stage specified at the determining is for stopping any one of the exposing unit, the transfer unit, the neutralization unit, and the removing unit, the determining further includes determining that the stopping process is interruptible.

10. The control method according to claim 7, wherein the image forming unit includes an image carrier on which a toner image is formed, a driving unit that drives the image carrier, a charging unit that charges the image carrier, an exposing unit that forms a latent image on the image carrier by exposing the image carrier charged by the charging unit, and a developing unit that causes toner to adhere to the latent image to form a toner image on the image carrier, and when the stopping process at a stage specified at the determining is for stopping any one of the charging unit, the developing unit, and the driving unit, the determining further includes determining that the stopping process is not interruptible.

11. The control method according to claim 7, further comprising:

detecting an abnormality of the image forming apparatus, wherein when the abnormality is detected at the detecting, the controlling includes continuing the stopping process regardless of the instruction for executing the image forming process.

12. The control method according to claim 7, wherein when instructed at the starting-up to perform the starting process, the controlling includes performing the starting process at a stage in which the stopping process is not performed.

* * * * *